US009874184B2

(12) United States Patent
Raedt et al.

(10) Patent No.: US 9,874,184 B2
(45) Date of Patent: Jan. 23, 2018

(54) INTERNALLY PRESSURIZED COMPONENT

(71) Applicant: Hirschvogel Umformtechnik GmbH, Denklingen (DE)

(72) Inventors: Hans-Willi Raedt, Buchloe (DE); Gordon Triesch, Kaufering (DE); Clemens Hutterer, Peiting (DE)

(73) Assignee: Hirschvogel Umformtechnik GmbH, Denklingen (DE)

( * ) Notice: Subject to any disclaimer, the term of this patent is extended or adjusted under 35 U.S.C. 154(b) by 44 days.

(21) Appl. No.: 15/206,681

(22) Filed: Jul. 11, 2016

(65) Prior Publication Data

US 2017/0009719 A1 Jan. 12, 2017

(30) Foreign Application Priority Data

Jul. 9, 2015 (DE) ..... 10 2015 212 868

(51) Int. Cl.

| | |
|---|---|
| ***F02M 55/00*** | (2006.01) |
| ***F02M 55/02*** | (2006.01) |
| ***F02M 61/16*** | (2006.01) |
| ***F02M 55/04*** | (2006.01) |

(52) U.S. Cl.

CPC ..... *F02M 55/025* (2013.01); *F02M 55/04* (2013.01); *F02M 61/168* (2013.01)

(58) Field of Classification Search

CPC ..... F02M 55/025; F02M 55/04; F02M 61/168
USPC ..... 123/456, 468, 469
See application file for complete search history.

(56) References Cited

U.S. PATENT DOCUMENTS

| | | | | |
|---|---|---|---|---|
| 9,234,511 | B2 * | 1/2016 | Hopley | F02M 59/02 |
| 2004/0080156 | A1 * | 4/2004 | Usui | F02M 55/005 285/133.11 |
| 2004/0103576 | A1 * | 6/2004 | Wagner | B21C 1/24 42/76.1 |
| 2011/0041946 | A1 * | 2/2011 | Hagedorn | B21C 37/154 138/142 |
| 2011/0209803 | A1 * | 9/2011 | Sugimoto | C21D 1/20 148/653 |
| 2013/0186371 | A1 * | 7/2013 | Pascuzzi | F02M 55/025 123/456 |
| 2015/0338023 | A1 * | 11/2015 | Coors | F17C 13/026 138/30 |

FOREIGN PATENT DOCUMENTS

| | | |
|---|---|---|
| DE | 10 2009 000 538 A1 | 8/2010 |
| DE | 10 2011 013 099 A1 | 9/2012 |

* cited by examiner

*Primary Examiner* — Thomas Moulis
(74) *Attorney, Agent, or Firm* — Muncy, Geissler, Olds & Lowe, P.C.

(57) ABSTRACT

An internally pressurized component is provided that includes a main body having at least one cavity; at least one branch having a bore which runs through the branch into the cavity of the main body; at least one separate insert element which is arranged in frictionally locking fashion at least partially in the bore of the branch. The component, at least in that region of the bore at which the separate insert element is arranged, is formed, by way of an autofrettage treatment, as a compacted wall region, and the separate insert element is arranged with an oversize in the bore.

16 Claims, 1 Drawing Sheet

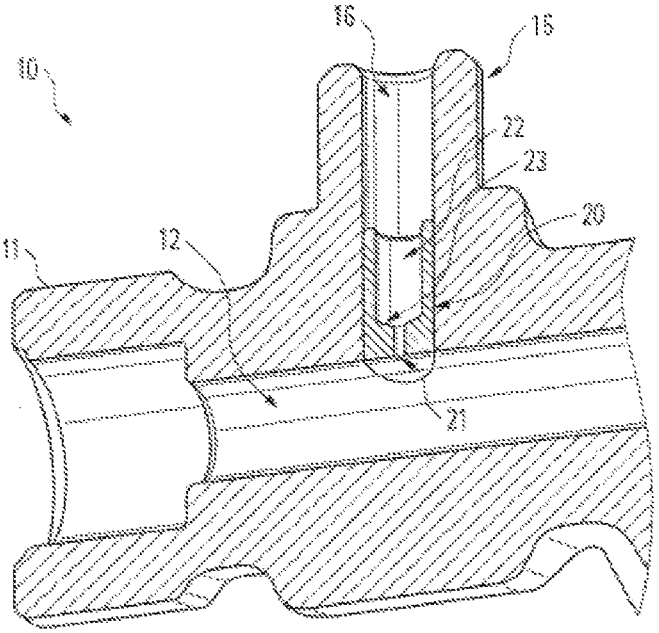
16
15
10
22
23
20
11
12
21

INTERNALLY PRESSURIZED COMPONENT

This nonprovisional application claims priority under 35 U.S.C. § 119(a) to German Patent Application No. 10 2015 212 868.7, which was filed in Germany on Jul. 9, 2015, and which is herein incorporated by reference.

BACKGROUND OF THE INVENTION

Field of the Invention

The present invention relates to an internally pressurized component, in particular a high-pressure fuel accumulator for a common-rail fuel injection system of a motor vehicle, and to a method for producing an internally pressurized component of said type.

Description of the Background Art

A multiplicity of internally pressurized components, in particular for injection components of a motor vehicle, is known from the prior art. Such components may in this case be subjected to pressure loads of several hundred MPa, wherein, depending on the application, such pressure loads may also arise as pulsating pressure loads, which are particularly critical for the component.

To increase the compressive strength of such components, it is known in the prior art for such components to be subjected to a so-called autofrettage treatment, by way of which a considerable increase in strength of the components or of individual wall sections can be realized. Here, the component is subjected to an internal pressure which is higher than a subsequent operating pressure and higher than the yield strength of the material, specifically in such a way that regions on the inner wall of the component are plasticized, whereas regions on the outer wall remain elastic. As a result of the plasticized inner region, the elastically deformed outer region is prevented from fully deforming back into its initial position, such that the outer region remains expanded, and thus, in the inner region, an internal compressive stress is generated which counteracts the operating load. As a result, by way of an autofrettage treatment, the compressive strength of a component can be considerably increased. The known methods for autofrettage treatment are however increasingly reaching their limits, in particular with regard to the very high autofrettage pressures required for the autofrettage treatment and with regard to the material strength of the component itself.

It is also known in the prior art for separate inserts as so-called pressure oscillation dampers to be arranged in frictionally locking fashion within an internally pressurized component. Said separate inserts in this case comprise a reduced cross-sectional region, for example in the form of a bore running through the insert. Such separate inserts are however not suitable, or not adequately suitable, for increasing the compressive strength of a component, because the frictionally locking connection of separate insert and the component does not, or does not adequately, withstand the high pressure loading.

SUMMARY OF THE INVENTION

It is therefore an object of the present invention to provide an internally pressurized component, and a method for producing such a component, which exhibits improved pressure resistance, in particular at branches or bends and the like.

An internally pressurized component according to an exemplary embodiment of the invention comprises at least: a main body having at least one cavity; at least one branch having a bore which runs through the branch into the cavity of the main body; at least one separate insert element which is arranged in frictionally locking fashion at least partially in the bore of the branch; wherein the component, at least in that region of the bore at which the separate insert element is arranged, is formed, by way of an autofrettage treatment, as a compacted wall region, and wherein the separate insert element is arranged with an oversize in the bore.

In other words, the present invention proposes that the autofrettage treatment of the component be used not directly for increasing the compressive strength of the component, such as has hitherto been conventional in the prior art, but for making it possible for a separate insert element to be arranged, with the greatest possible oversize, in frictionally locking fashion in the component. In this way, it is possible for very high pressure loads to be accommodated by the separate insert element too, because the frictionally locking connection between separate insert element and component can withstand high pressure loads owing to the large oversize that is now possible. Here, the separate insert may be provided in targeted fashion in those regions at which the bores of the component intersect. The separate insert, which is preferably produced from a high-strength material, can thus be provided in the most critical regions of the component and, there, increase the compressive strength of the component. Since such inserts are basically geometrically simple components, the production thereof is furthermore likewise easily possible.

The separate insert element is preferably arranged with an oversize of between 5 μm and 60 μm, preferably between 10 μm and 40 μm, particularly preferably between 15 μm and 30 μm, and furthermore particularly preferably of approximately 20 μm, in the bore of the branch. Here, it is preferable for the separate insert element to have a circular cross section corresponding to the bore, and to have an external diameter of between 2 mm and 18 mm, preferably between 4 mm and 14 mm, and particularly preferably of approximately 6 mm.

The separate insert element advantageously has at least one region with a reduced cross section. Such a reduced cross section may be realized for example by way of a corresponding section with a (throttle) bore. In this way, the separate insert element can particularly advantageously also be used as a throttle element (as a so-called pressure oscillation damper), for example in a high-pressure fuel accumulator for a common-rail injection system of a motor vehicle.

The separate insert element is preferably produced from a high-strength material with a tensile strength of >1200 MPa, and the component is preferably produced from a high-strength material with a tensile strength of >900 MPa.

It is advantageously the case that the cavity of the main body is an elongate cavity and preferably has a circular cross section. Here, it is also preferable for the component to have multiple branches with corresponding bores.

It is particularly preferable here for all regions of the component to be formed, by way of an autofrettage treatment (preferably via all cavities), as compacted wall regions.

The internally pressurized component is preferably a part of a high-pressure fuel accumulator for a common-rail fuel injection system of a motor vehicle, in particular of a diesel common rail or of a gasoline common rail, of a pump or of a hydraulic installation of a motor vehicle. Furthermore, the present invention may also be used in particular in an edge-type filter in an injection nozzle. In these applications in particular, very high pressure loads or pulsating pressure loads can arise, such that the use of the present invention in such applications is particularly advantageous. However, the present invention is not restricted to these exemplary applications, but may basically be used in all components with branches, intersecting bores or the like in which high or pulsating pressure loads can arise.

The present invention also relates to a method for producing an above-described internally pressurized component, comprising at least the following steps: providing a component (which has preferably been produced by way of a casting or a forging process) having a main body which has at least one cavity, wherein, on the main body, there is provided at least one branch having a bore which runs through the branch into the cavity of the main body; forming at least one compacted wall region in the region of the bore by way of an autofrettage treatment; arranging a separate insert element in frictionally locking fashion in the bore of the branch such that the insert element is arranged at least partially in the bore in the region of the compacted wall region, wherein the separate insert element is arranged with an oversize in the bore.

A pressure of between 2000 and 16,000 bar is preferably used for the autofrettage treatment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus, is not limitive of the present invention, and wherein the sole FIGURE illustrates an example embodiment, showing a schematic (partial) cross-sectional view of aN embodiment of an internally pressurized component in the form of a high-pressure fuel accumulator for a common-rail fuel injection system of a motor vehicle.

DETAILED DESCRIPTION

FIG. 1 shows a schematic (partial) cross-sectional view of a preferred embodiment of an internally pressurized component 10 in the form of a high-pressure fuel accumulator for a common-rail fuel injection system of a motor vehicle.

As can be clearly seen in FIG. 1, the component 10 has an elongate main body 11 with an elongate cavity 12. The elongate cavity 12 is preferably fluidically connected to a (fuel) pump. The elongate cavity 12 preferably has a diameter of between 5 and 35 mm.

On the elongate main body 11 there is arranged at least one branch 15. In the preferred embodiment of the component 10 as a high-pressure fuel accumulator, corresponding injection systems (not shown) of the common-rail fuel injection system may be provided on the branch 15 or on branches 15. The component 10 is preferably formed substantially as an integral component.

In the branch 15 there is provided at least one (through) bore 16 which extends (preferably vertically or in some other, in particular oblique orientation relative to one another) into the cavity 12 of the main body 11. At least one separate insert element 20 is arranged in the bore 16. As can likewise be clearly seen in FIG. 1, the separate insert element 20 extends, in the bore 16, as far as the cavity 12 of the main body 11, wherein the separate insert element 20 is preferably arranged so as to terminate flush with the cavity 12 of the main body 11. Other configurations are also conceivable here. Accordingly, that surface of the separate insert element 20 which is assigned to the cavity 12 may for example also be provided so as to project in planar form or be recessed in planar form relative to the cavity 12, or may be provided in other geometric configurations.

The separate insert element 20 furthermore has a (throttle) bore 21. Here, the separate insert element 20 may be in the form of a solid body, such that the bore 21 runs all the way through the separate insert element 20 (not shown), or it is possible, as shown in FIG. 1, for only a limited region of the separate insert element 20 to be formed with a reduced cross section, such that the bore 21 runs only through said region.

As can be seen from FIG. 1, the separate insert element 20 may have, adjoining the bore 21, a widened region 22 of relatively large cross section (in relation to the (throttle) bore 21). The bore 21 and the widened region 22 are in this case preferably connected to one another by way of a step 23. The widened region 22 can facilitate the insertion or pressing-in process, by virtue of the separate insert element 20 with the widened region 22 being mounted onto a corresponding tool. During the insertion of the separate insert element 20 into the bore 16, the tool is then supported on the step 23, which facilitates the insertion process. The widened region 22 is preferably provided, in relation to the (throttle) bore 21, so as to be averted from the cavity 12, and particularly preferably so as to be oriented coaxially with respect to the bore 21.

In the preferred embodiment shown, the entire component 10 has been impacted by way of an autofrettage treatment, that is to say not only the region at which the separate insert element 20 is arranged in the bore 16. As a result of the autofrettage treatment, it is now possible for the separate insert element 20 to be arranged with a relatively large oversize (in the embodiment shown, approximately 20 μm) in the bore 16 in frictionally locking fashion, such that the frictionally locking connection between separate insert element 20 and the component 10 can reliably withstand very high pressure loads.

A preferred method for producing the internally pressurized component 10 shown in FIG. 1 will be discussed below:

in a first step, a component (which has preferably been produced by way of a casting or forging process) having a main body 11 and having at least one branch 15 is provided. In this case, the main body 11 comprises at least one cavity 12 and the branch 15 comprises at least one bore 16, which runs through the branch 15 into the cavity 12 of the main body 11.

In a further step, a compaction of at least the wall region in the region of the bore 16 is performed by way of an autofrettage treatment.

Finally, the separate insert element 20 is arranged in frictionally locking fashion (at least partially) in the bore 16 of the branch 15, wherein the separate insert element 20 is arranged with an oversize of approximately 20 μm in the bore 16 of the branch 15. Here, the separate insert element 20 is preferably pushed into the bore 16 to such an extent as to run flush with the cavity 12 of the main body 11.

Here, the present invention is not restricted to the preferred exemplary embodiment above, as long as it is encompassed by the subject matter of the following claims. In particular, the present invention is not restricted to specific applications, but may basically be used in all components/ parts which have branches, intersecting bores or the like and in which high or pulsating pressure loads can arise.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An internally pressurized component comprising:

a main body having at least one cavity;

at least one branch having a bore that runs through the branch into the cavity of the main body; and at least one separate insert element that is arranged in frictionally locking fashion at least partially in the bore of the branch, wherein the component, at least in a region of the bore at which the separate insert element is arranged, is formed, by way of an autofrettage treatment, as a compacted wall region, and wherein the separate insert element is arranged with an oversize in the bore.

2. The internally pressurized component according to claim 1, wherein the separate insert element extends in the bore as far as the cavity of the main body, and wherein the separate insert element terminates flush with the cavity of the main body.

3. The internally pressurized component according to claim 1, wherein the separate insert element is arranged with an oversize of between 5 μm and 60 μm, between 10 μm and 40 μm, between 15 μm and 30 μm, or approximately 20 μm in the bore.

4. The internally pressurized component according to claim 1, wherein the separate insert element has a circular cross section and an external diameter of between 2 mm and 18 mm, between 4 mm and 14 mm, or approximately 6 mm.

5. The internally pressurized component according to claim 1, wherein the separate insert element has at least one region with a reduced cross section.

6. The internally pressurized component according to claim 1, wherein the separate insert element is produced from a high-strength material with a tensile strength of >1200 MPa.

7. The internally pressurized component according to claim 1, wherein the cavity of the main body is an elongate cavity and has a circular cross section.

8. The internally pressurized component according to claim 1, wherein the component has multiple branches.

9. The internally pressurized component according to claim 1, wherein the component is produced from a tensile-stress-resistant material.

10. The internally pressurized component according to claim 1, wherein all regions of the component are formed, by way of an autofrettage treatment, as compacted wall regions.

11. The internally pressurized component according to claim 1, wherein the component is a part of a high-pressure fuel accumulator for a common-rail fuel injection system of a motor vehicle, a diesel common rail, a gasoline common rail, a pump, or a hydraulic installation of a motor vehicle.

12. A method for producing an internally pressurized component, the method comprising:

providing a component having a main body that has at least one cavity, wherein, on the main body, there is provided at least one branch having a bore that runs through the branch into the cavity of the main body;

forming at least one compacted wall region in a region of the bore via an autofrettage treatment; and arranging a separate insert element in a frictionally locking fashion in the bore of the branch such that the separate insert element is arranged at least partially in the bore in the region of the compacted wall region, wherein the separate insert element is arranged with an oversize in the bore.

13. The method according to claim 12, wherein the separate insert element is arranged with an oversize of between 5 μm and 60 μm, between 10 μm and 40 μm, between 15 μm and 30 μm, or approximately 20 μm in the bore.

14. The method according to claim 12, wherein a pressure of between 2000 and 16,000 bar is used for the autofrettage treatment.

15. The method according to claim 12, wherein the separate insert element has a circular cross section and has an external diameter of between 2 mm and 18 mm, between 4 mm and 14 mm, or approximately 6 mm.

16. The method according to claim 12, wherein the provided component is produced by way of a casting or a forging process.

* * * * *